US009851657B2

(12) United States Patent
Okuda

(10) Patent No.: US 9,851,657 B2
(45) Date of Patent: Dec. 26, 2017

(54) IMAGE FORMING APPARATUS

(71) Applicant: Sharp Kabushiki Kaisha, Osaka (JP)

(72) Inventor: Takeshi Okuda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/802,133

(22) Filed: Jul. 17, 2015

(65) Prior Publication Data

US 2016/0054680 A1 Feb. 25, 2016

(30) Foreign Application Priority Data

Aug. 22, 2014 (JP) ..... 2014-169163
Dec. 2, 2014 (JP) ..... 2014-243778

(51) Int. Cl.

*G03G 15/08* (2006.01)
*G03G 21/18* (2006.01)
*G03G 21/16* (2006.01)

(52) U.S. Cl.

CPC ..... *G03G 15/0875* (2013.01); *G03G 21/1676* (2013.01); *G03G 21/1864* (2013.01); *G03G 2215/066* (2013.01); *G03G 2215/068* (2013.01); *G03G 2215/0663* (2013.01); *G03G 2215/0665* (2013.01)

(58) Field of Classification Search

CPC ..... G03G 15/0875; G03G 21/1864; G03G 2215/066; G03G 2215/0663; G03G 2215/0665; G03G 2215/068

See application file for complete search history.

(56) References Cited

U.S. PATENT DOCUMENTS

2009/0016779 A1* 1/2009 Hwang ..... G03G 15/0855 399/258
2009/0214269 A1* 8/2009 Choi ..... G03G 15/0877 399/258
2009/0324297 A1* 12/2009 Usui ..... G03G 15/0896 399/262
2012/0155926 A1* 6/2012 Okuda ..... G03G 15/0875 399/263
2014/0334848 A1* 11/2014 Katsuyama ..... G03G 15/0875 399/258

FOREIGN PATENT DOCUMENTS

JP 2010-256557 11/2010
JP 2011-008142 1/2011
JP 2011-059296 3/2011

* cited by examiner

*Primary Examiner* — Ryan Walsh
(74) *Attorney, Agent, or Firm* — Renner, Otto, Boisselle & Sklar, LLP

(57) ABSTRACT

An image forming apparatus includes a cartridge storage portion that is installed in an image forming apparatus main body, and a toner cartridge that is configured so as to be able to be inserted into and removed from the cartridge storage portion. The cartridge storage portion has a storage opening that receives the toner cartridge, and has a gap between an end part of the toner cartridge and the storage opening, through which the end part of the toner cartridge is not able to be held, when the toner cartridge is stored in the cartridge storage portion.

6 Claims, 17 Drawing Sheets

IMAGE FORMING APPARATUS

CROSS-NOTING PARAGRAPH

This non-provisional application claims priorities under 35 U.S.C. §119(a) on Patent Applications No. 2014-169163 filed in JAPAN on Aug. 22, 2014 and No. 2014-243778 filed in JAPAN on Dec. 2, 2014, the entire contents of which are hereby incorporated herein by reference.

FIELD OF THE INVENTION

The present invention relates to an image forming apparatus including a cartridge storage portion that is installed in an image forming apparatus main body and a toner cartridge that is configured so as to be able to be inserted into and removed from the cartridge storage portion.

BACKGROUND OF THE INVENTION

In an electrophotographic image forming apparatus, a charging device charges a surface of an electrostatic latent image carrier (for example, photoreceptor), an exposure device exposes the charged region according to image information to form an electrostatic latent image, and a developing device develops this electrostatic latent image with toner.

This developing device includes a toner cartridge in which toner is stored, and all the stored toner is desired to be used up. For example, Japanese Laid-Open Patent Publication No. 2011-8142, Japanese Laid-Open Patent Publication No. 2010-256557 and Japanese Laid-Open Patent Publication No. 2011-59296 disclose a technology in which a mechanism which locks pulling-out of a toner cartridge so as not to be pulled out by a user easily even when it is detected that there is no toner is provided, in which it is not able to be pulled out unless operation for releasing lock is performed on an operation screen of an image forming apparatus main body.

However, since Japanese Laid-Open Patent Publication No. 2011-8142, Japanese Laid-Open Patent Publication No. 2010-256557 and Japanese Laid-Open Patent Publication No. 2011-59296 have a structure in which a cover of the image forming apparatus main body is locked, there is a problem that, supposedly, when lock of the cover of the image forming apparatus main body is able to be released on the operation screen or when the cover of the image forming apparatus main body is able to be opened, the toner cartridge is able to be detached from the image forming apparatus main body and toner is not able to be used up.

SUMMARY OF THE INVENTION

An object of the present invention is to provide an image forming apparatus capable of preventing a toner cartridge from being detached from an image forming apparatus main body without using a mechanism of locking pulling-out of the toner cartridge so that toner is able to be used up.

An object of the present invention is to provide an image forming apparatus, comprising: a cartridge storage portion that is installed in an image forming apparatus main body; and a toner cartridge that is configured so as to be able to be inserted into and removed from the cartridge storage portion, wherein the cartridge storage portion has a storage opening that receives the toner cartridge, and has a gap between an end part of the toner cartridge and the storage opening, through which the end part of the toner cartridge is not able to be held, when the toner cartridge is stored in the cartridge storage portion.

Another object of the present invention is to provide the image forming apparatus, wherein the image forming apparatus further includes a driving unit that is installed in the image forming apparatus main body and configured so as to be removable from the toner cartridge, and the driving unit has a toner cartridge pushing-out device that allows the end part of the toner cartridge to be held by pushing out the toner cartridge when the toner cartridge is detached from the driving unit.

Another object of the present invention is to provide the image forming apparatus, wherein the toner cartridge pushing-out device has an arm member capable of pushing out the toner cartridge, a cam member that rotates based on driving force from the driving unit and pushes the arm member in a direction to be proximate to the toner cartridge, and a spring member that biases the arm member in a direction away from the toner cartridge.

Another object of the present invention is to provide the image forming apparatus, wherein the toner cartridge pushing-out device pushes out the toner cartridge when the toner remaining amount in the toner cartridge is detected to be zero.

Another object of the present invention is to provide the image forming apparatus, wherein the toner cartridge further includes a toner conveyance member or a stirring member that is driven by the driving unit, and the toner cartridge pushing-out device pushes out the toner cartridge when abnormality of toner conveyance operation by the toner conveyance member or stirring operation by the stirring member is detected.

Another object of the present invention is to provide the image forming apparatus, wherein the image forming apparatus further includes an operation portion that receives operation for the image forming apparatus, and the toner cartridge pushing-out device pushes out the toner cartridge when detachment of the toner cartridge is set at the operation portion.

Moreover, an object of the present invention is to provide an image forming apparatus capable of preventing a toner cartridge from being detached from a driving unit.

An object of the present invention is to provide an image forming apparatus, comprising: a driving unit that is installed in an image forming apparatus main body; and a toner cartridge that is configured so as to be removable from the driving unit, wherein the driving unit has a locking member that is engaged with the toner cartridge to prevent the toner cartridge from being detached from the driving unit.

Another object of the present invention is to provide the image forming apparatus, wherein the locking member is engaged with the toner cartridge when a toner remaining amount in the toner cartridge is not detected to be zero, and is released from the engagement with the toner cartridge when the toner remaining amount in the toner cartridge is detected to be zero.

Another object of the present invention is to provide the image forming apparatus, wherein the toner cartridge further includes a toner conveyance member or a stirring member that is driven by the driving unit, and the locking member is released from the engagement with the toner cartridge when abnormality of toner conveyance operation by the toner conveyance member or stirring operation by the stirring member is detected.

Another object of the present invention is to provide the image forming apparatus, wherein the image forming apparatus further includes an operation portion that receives operation for the image forming apparatus, and the locking member is released from the engagement with the toner cartridge when detachment of the toner cartridge is set at the operation portion.

Another object of the present invention is to provide the image forming apparatus, wherein the driving unit has a spring that biases the locking member in a direction to be engaged with the toner cartridge, and a cam that rotates based on driving force from the driving unit and presses the locking member in a direction away from the toner cartridge.

Another object of the present invention is to provide the image forming apparatus, wherein the driving unit has a cam that rotates in one direction to cause the locking member to be engaged with the toner cartridge as well as rotates in an opposite direction to cause the locking member to be separated from the toner cartridge, and a motor for a cam that rotates the cam.

Another object of the present invention is to provide the image forming apparatus, wherein the driving unit has a solenoid that operates so that the locking member is caused to be engaged with the toner cartridge by turning-on operation and operates so that the locking member is caused to be separated from the toner cartridge by turning-off operation.

PREFERRED EMBODIMENTS OF THE INVENTION

Figure 1:
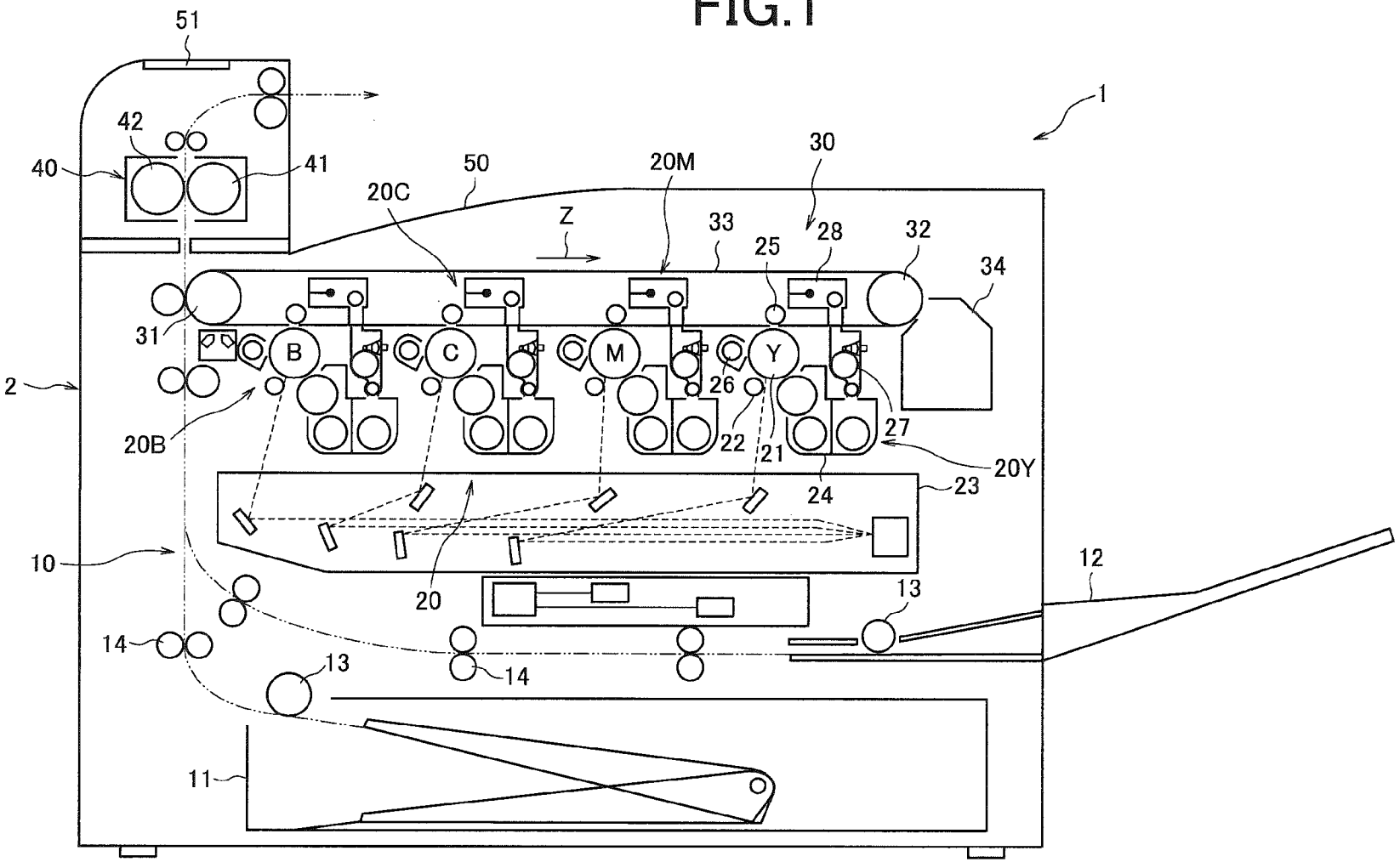
FIG. 1 is a schematic view of an image forming apparatus of the present invention.

Description will hereinafter be given for embodiments of the present invention specifically with reference to drawings. FIG. 1 is a schematic view of an image forming apparatus of the present invention.

An image forming apparatus 1 is able to apply predetermined image processing to image data transmitted from an external device via a network and output a color image or a monochrome image to a sheet of paper. Note that, though description will be given by taking an example of a printer in FIG. 1, the image forming apparatus of the present invention may be a copy machine, a facsimile apparatus, a multi-functional peripheral including functions thereof, or the like capable of applying predetermined image processing to image data read by a scanner or the like and outputting a color image or a monochrome image to a sheet of paper.

The image forming apparatus 1 includes a supply portion 10, an image forming portion 20, a conveyance portion 30 and a fixing portion 40 inside an image forming apparatus main body 2, for example, in a box shape. The supply portion 10 supplies a sheet of paper to the image forming portion 20 at a predetermined timing, and the image forming portion 20 forms a toner image on the sheet of paper.

Specifically, the supply portion 10 has a paper feed tray 11 and a manual tray 12, and sheets of paper in the paper feed tray 11 and the manual tray 12 are sent to the image forming portion 20 through a pickup roller 13 and a conveyance roller 14.

The image forming portion 20 has, for example, a tandem system, and has four stations 20Y, 20M, 20C and 20B for a yellow image, a magenta image, a cyan image and a black image.

The station 20Y for a yellow image is arranged in a vicinity of a belt cleaning device 34, and the station 20B for a black image is arranged in a vicinity of a fixing portion 40, respectively, and the station 20Y for a yellow image, the station 20M for a magenta image, the station 20C for a cyan image and the station 20B for a black image are arranged in this order when viewed in a direction in which a conveyance belt 33 of the conveyance portion 30 moves.

Each of the stations 20Y, 20M, 20C and 20B has substantially same components. Therefore, reference numerals are assigned to the components of the station 20Y for a yellow image and reference numerals to components of other stations 20M, 20C and 20B are omitted in FIG. 1. Note that, in addition to the aforementioned four colors, for example, a light cyan (LC) or a light magenta (LM) which has same color hue as that of cyan or magenta and has a low density may be added.

To give description by taking the station 20Y for a yellow image as an example, this station 20Y has a photoreceptor 21, and around the photoreceptor 21, when viewed in a rotation direction thereof, a charging device 22, an exposure device 23, a developing device 24, a transfer roller 25, and a photoreceptor cleaning device 26 are arranged in this order.

The photoreceptor 21 is in a cylindrical shape, has a surface formed by, for example, an OPC (organic photo conductor) or the like, and is rotatable in a predetermine direction by a driving device (not shown in the figure).

The charging device 22, for example, has a roller which makes contact with the surface of the photoreceptor 21, and charges the surface of the photoreceptor 21 to a predetermined polarity (for example, minus) uniformly. Note that, a charging device of a brush system, an ion emission system or the like may be used in addition to one of a contact-type roller system.

The exposure device 23 irradiates the surface of the photoreceptor 21 which is charged with laser light based on the aforementioned image data, and an electrostatic latent image according to the image data is formed on the surface of the photoreceptor 21. Note that, an exposure device such as a writing head in which light emitting elements such as LEDs are arranged in an array may be used in addition to a laser scanning unit (LSU) including a laser irradiation portion and a reflection mirror.

The developing device 24 develops the electrostatic latent image formed on the surface of the photoreceptor 21 with toner to form a visible image (also referred to as a toner image). The toner is supplied from a toner cartridge 28 which is coupled to the developing device 24, and is charged with a same polarity (for example, minus) with a surface potential of the photoreceptor 21. An intermediate hopper 27 in which toner is accumulated temporarily is provided between the toner cartridge 28 and the developing device 24. Only the toner may be stored or carrier may be mixed therewith to be stored in the toner cartridge 28.

The transfer roller 25 faces the photoreceptor 21 across the conveyance belt 33. When a bias voltage with a polarity (for example, plus) opposite to a charging polarity of the toner is applied to the transfer roller 25, the toner image on the photoreceptor 21 is transferred to a sheet of paper on the conveyance belt 33.

The photoreceptor cleaning device 26 removes the toner remaining on the surface of the photoreceptor 21 after transfer onto the sheet of paper, and the toner removed from the photoreceptor 21 is collected, for example, into an inside of the photoreceptor cleaning device 26.

The conveyance portion 30 includes a driving roller 31, a driven roller 32 and the conveyance belt 33. For example, the driving roller 31 is arranged in the vicinity of the fixing portion 40, and the driven roller 32 is arranged in the vicinity of the belt cleaning device 34, respectively, and the conveyance belt 33 is hung around between the driving roller 31 and the driven roller 32. In the case of outputting a color image, when the conveyance belt 33 moves in a direction of an arrow Z, toner images of respective colors from the stations 20Y, 20M, 20C and 20B are transferred onto the conveyance belt 33 in order, and then transferred onto the sheet of paper from the conveyance belt 33.

The fixing portion 40 includes a heating roller 41 and a pressure roller 42, and fixes the toner images transferred onto the sheet of paper at a nip portion thereof. Then, in the case of outputting only to a front side of the sheet of paper, the sheet of paper delivered from the fixing portion 40 is discharged to a paper discharge tray 50.

Figure 2:
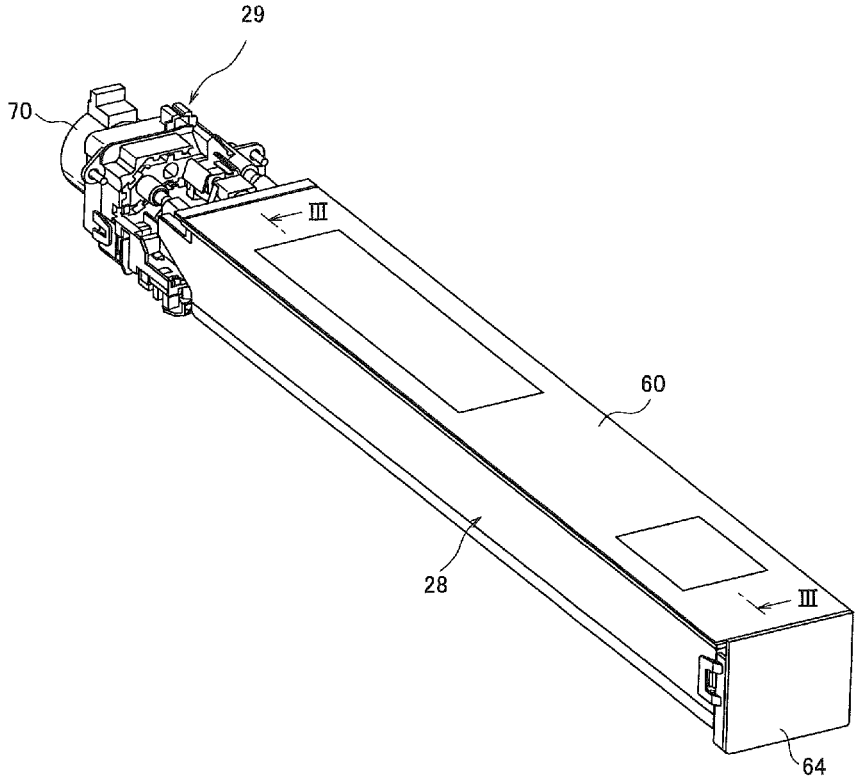
FIG. 2 is a perspective view showing a state where a toner cartridge and a driving unit are mounted.
Figure 3:
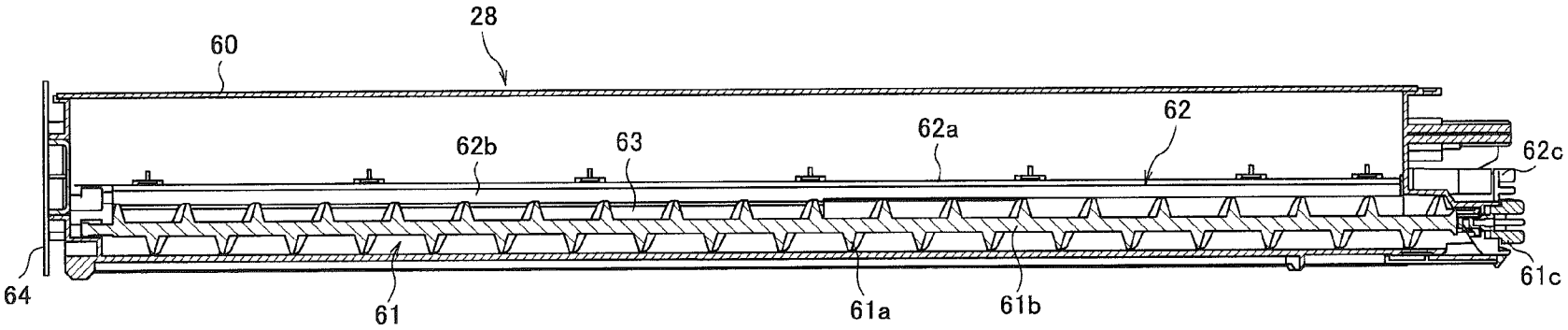
FIG. 3 is a cross-sectional view of the toner cartridge.

FIG. 2 is a perspective view showing a state where the toner cartridge and a driving unit of the present invention are mounted, and FIG. 3 is a cross-sectional view of the toner cartridge.

As shown in FIG. 2, the toner cartridge 28 includes a container main body 60 which is formed thin and long along a lateral direction. The toner cartridge 28 is provided for each color, and in the case of the example described in FIG. 1, four toner cartridges 28 in total are arranged in the image forming apparatus main body 2.

In the image forming apparatus main body 2, four cartridge storage portions 80 in total described below in FIG. 5 and the like, which respectively correspond to the toner cartridges 28 of the respective colors are installed, and each driving unit 29 is installed in a depth side of each of the cartridge storage portions 80.

A front cover 64 is positioned at a rear end surface with respect in an insertion direction of the toner cartridge 28, and by causing the toner cartridge 28 to go frontward in the cartridge storage portion 80 along a longitudinal direction thereof with an opposite side to the front cover 64 set in a front, and, as shown in FIG. 2, coupling the toner cartridge 28 to the driving unit 29 which is positioned in the depth side of the cartridge storage portion 80, it is possible to stir or convey the toner in the container main body 60 with driving force of a motor 70 of the driving unit 29. On the other hand, by causing the toner cartridge 28 to go backward with respect to the driving unit 29 with the front cover 64 set in a front, it is possible to remove the toner cartridge 28 from the cartridge storage portion 80. Note that, the front cover 64 corresponds to an end part of a toner cartridge of the present invention.

FIG. 3 is a cross-sectional view taken along a III-III line of FIG. 2, and, for example, a toner conveyance member 61 and a stirring member 62 are arranged in parallel in the container main body 60 of the toner cartridge 28.

The toner conveyance member 61 has a rotation axis 61*b*, a screw 61*a* provided around the rotation axis 61*b*, and a driving transmission member 61*c* provided at a tip end of the rotation axis 61*b*. The toner conveyance member 61 is coupled to the motor 70 of the driving unit 29 via the driving transmission member 61*c* outside the container main body 60, and is rotatable in a predetermined direction with driving force of the motor 70.

The stirring member 62 has a sheet 62*a* whose material is, for example, PET or the like, a rotation axis 62*b* and a driving transmission member 62*c*, and the sheet 62*a* is formed, for example, in a thin plate shape having flexibility so as to be able to make contact with an inner surface of the container main body 60. In the same manner as the toner conveyance member 61, the stirring member 62 is coupled to the motor 70 of the driving unit 29 via the driving transmission member 62*c* outside the container main body 60, and is rotatable in a predetermined direction with driving force of the motor 70.

A partition wall 63 is disposed upright between the toner conveyance member 61 and the stirring member 62, and toner stirred by the stirring member 62 reaches around the toner conveyance member 61 over the partition wall 63. The toner collected to a surround of the toner conveyance member 61 is conveyed by the toner conveyance member 61 and is directed to the intermediate hopper 27 described in FIG. 1.

First Embodiment

Figure 4:
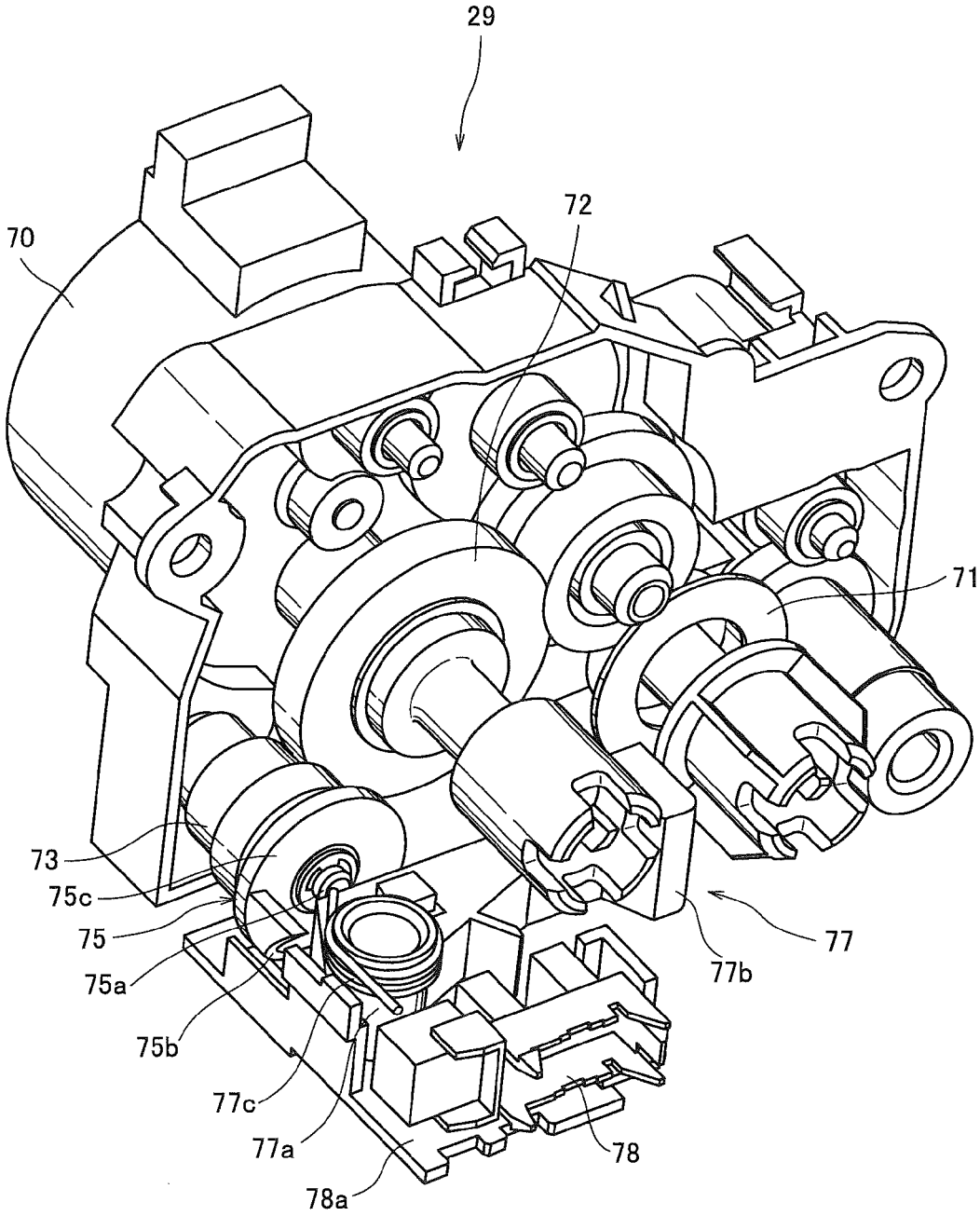
FIG. 4 is a perspective view of the driving unit according to a first embodiment.

FIG. 4 is a perspective view of the driving unit according to a first embodiment, which is viewed from obliquely left upward in the same manner as FIG. 2. The driving unit 29 has driving transmission members 71, 72 and 73 for transmitting driving force of the aforementioned motor 70, for example. The driving transmission member 71 is formed so as to be able to be coupled to the driving transmission member 61*c* shown in FIG. 3, and transmits the driving force of the motor 70 to the toner conveyance member 61. The driving transmission member 72 is formed so as to be able to be coupled to the driving transmission member 62*c*, and transmits the driving force of the motor 70 to the stirring member 62.

Here, the driving unit 29 has a toner cartridge pushing-out device. Specifically, it is composed of an eject cam 75, an eject arm 77 and an arm position detection sensor 78, and the arm 77 is formed so as to be able to abut against the toner cartridge 28 described in FIG. 2 and FIG. 3. Note that, the cam 75 corresponds to a cam member of the present invention and the arm 77 corresponds to an arm member of the present invention, respectively.

The driving transmission member 73 is coupled to the cam 75, and this cam 75 is configured so as to be rotatable, for example, with the driving force of the motor 70. A shaft of the cam 75 is connected to a one-way clutch (not shown in the figure), and the cam 75 runs idle in a predetermined rotation direction. Note that, the cam 75 may be rotatable with power transmitted from the driving transmission member 72 instead of the driving transmission member 73.

The cam 75 shown in FIG. 4 is, for example, a solid cam, and a convex portion 75*b* and a flat portion 75*c* are provided around a shaft portion 75*a*. The convex portion 75*b* rises toward the arm 77 in a range corresponding to, for example, a quarter rotation of the shaft portion 75*a*, and is formed at height capable of abutting against the arm 77. On the other hand, the flat portion 75*c* is provided in a range corresponding to, for example, three-quarters rotation of the shaft portion 75*a*, and is formed to be lower than the convex portion 75*b*.

The arm 77 has a shaft portion 77*a* which extends in a direction orthogonal to an axis line of the cam 75 in a vicinity thereof, and an arm portion 77*b* which is rotatable with respect to the shaft portion 77*a*. Moreover, a spring 77*c* (for example, torsion coil spring) is installed in the shaft portion 77*a* to bias the arm portion 77*b* in a direction away from the toner cartridge 28. Note that, the spring 77*c* corresponds to a spring member of the present invention.

The arm position detection sensor 78 having, for example, a light emitting element and a light receiving element is provided in a vicinity of the arm portion 77*b*, and when light from the light emitting element is blocked by the arm portion 77*b*, pushing-out position (also referred to as eject position) by the arm 77 is able to be detected. Note that, the arm position detection sensor 78 and the shaft portion 77*a* of the arm 77 are fixed to a pedestal 78*a* which extends from a lower end of the driving unit 29.

Figure 5:
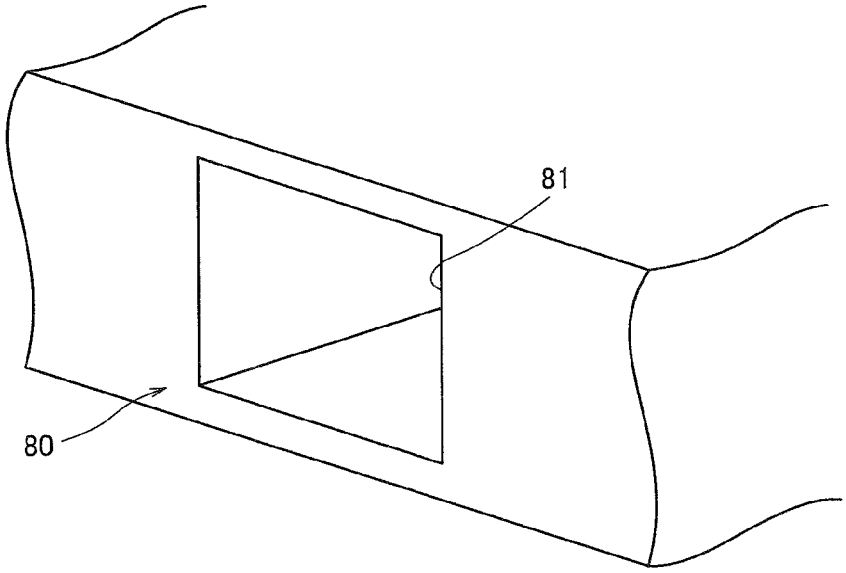
FIG. 5 is a perspective view of a cartridge storage portion.
Figure 6:
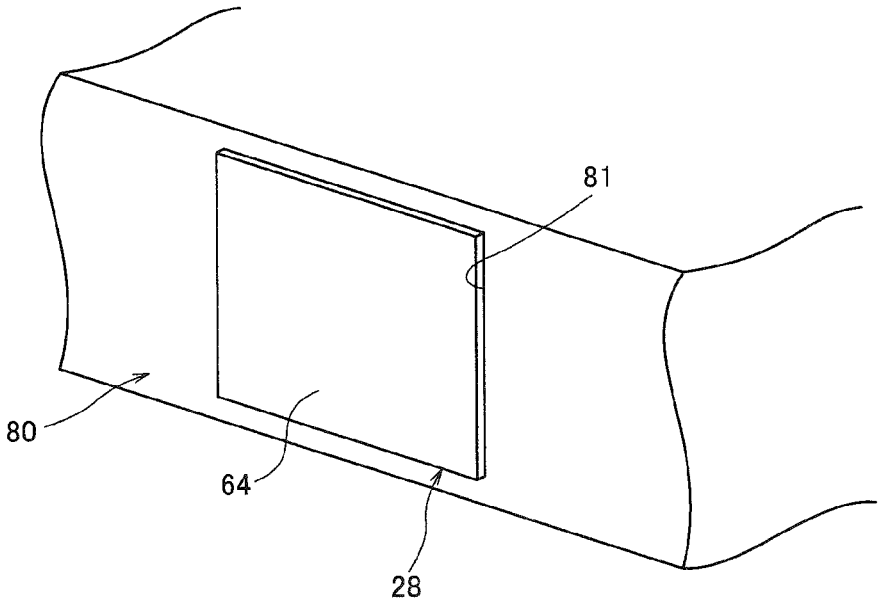
FIG. 6 is a view showing a state where the toner cartridge is attached.

FIG. 5 is a perspective view of the cartridge storage portion, and FIG. 6 is a view showing a state where the toner cartridge is attached. As shown in FIG. 5, the cartridge storage portion 80 has a storage opening 81 which is formed, for example, in a rectangular shape, and is formed thin and long toward the driving unit 29 described in FIG. 2 and the like so as to be able to receive the toner cartridge 28.

Specifically, the toner cartridge 28 is caused to go frontward along a longitudinal direction thereof with an opposite side to the front cover 64 described in FIG. 2 and FIG. 3 set in a front, and inserted into the cartridge storage portion 80 from the storage opening 81 shown in FIG. 5. Then, when the toner cartridge 28 is caused to go frontward until being coupled to the driving unit 29 which is positioned in the depth side of the cartridge storage portion 80 in a state where the front cover 64 is seen from a user, for example, a rear side (the side on an opposite side to the front side seen from the user) of the front cover 64 makes contact with a peripheral part of the storage opening 81, and, as shown in FIG. 6, the cartridge storage portion 80 does not cause a predetermined gap which allows holding the front cover 64, for example, a gap to an extent where a finger of the user enters therein to be formed between the rear side of the front cover 64 and the storage opening 81.

According to this first embodiment, the front cover 64 is positioned in a front side of the storage opening 81, but the rear side of the front cover 64 is hidden, so that the user is not able to hold this front cover 64. Thus, it is possible to prevent the toner cartridge from being detached from the image forming apparatus main body without using a mechanism for locking pulling-out of the cartridge so that tone is able to be used up.

Figure 7:
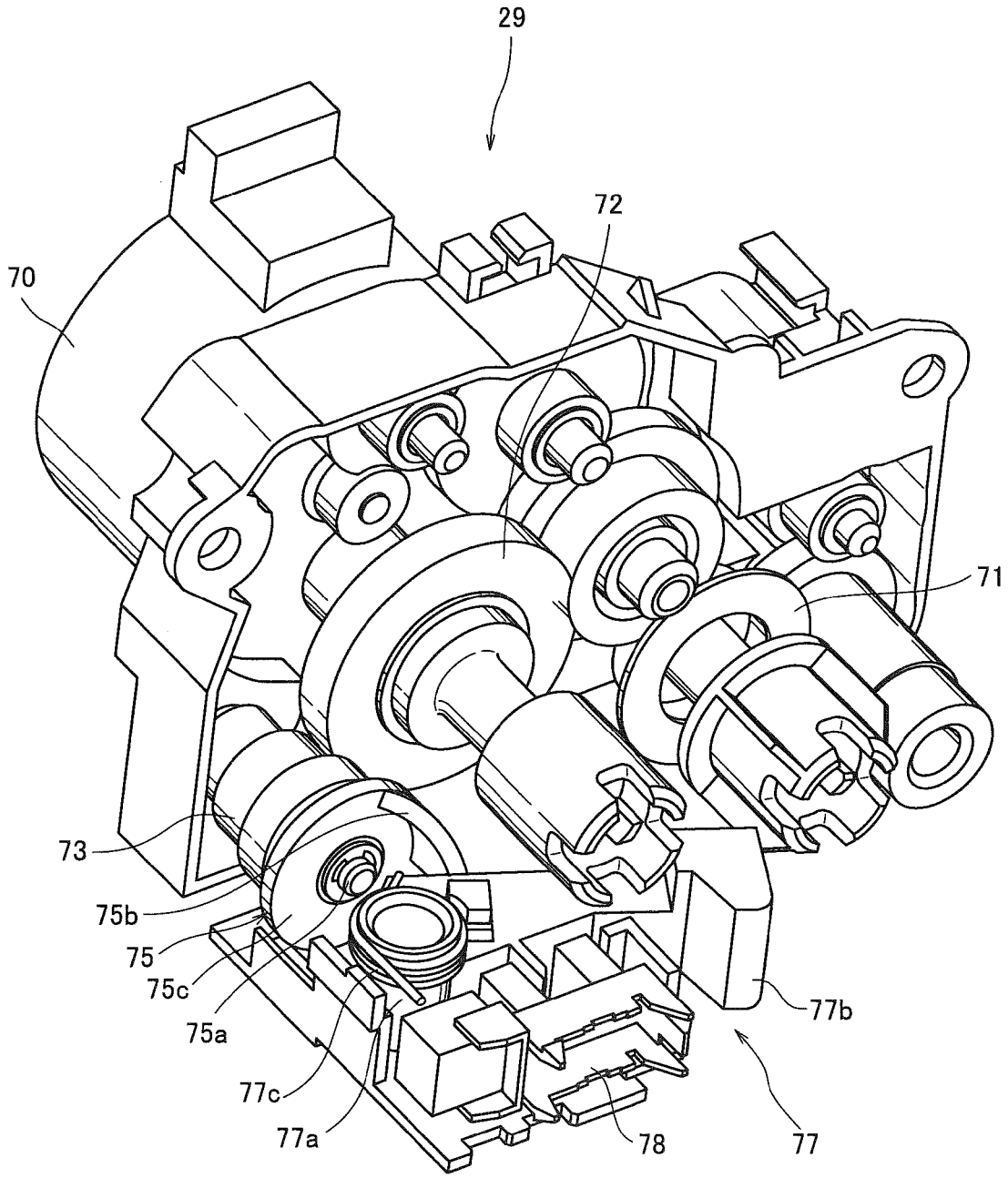
FIG. 7 is a view illustrating operation of the driving unit of FIG. 4.
Figure 8:
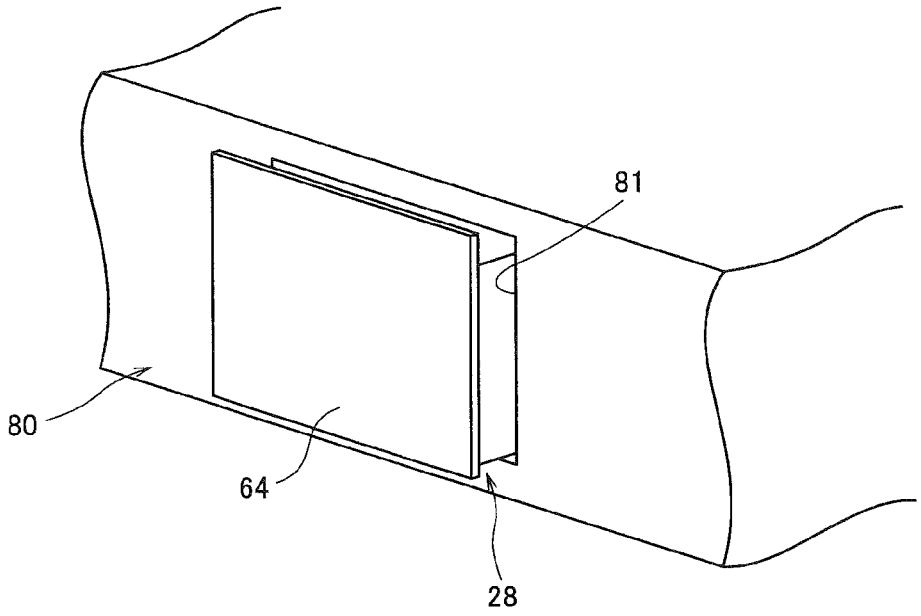
FIG. 8 is a view showing a replaceable state of the toner cartridge.

FIG. 7 is a view illustrating operation of the driving unit of FIG. 4, and FIG. 8 is a view showing a replaceable state of the toner cartridge. In the present embodiment, for example, based on a detected signal of a toner detection device (not shown in the figures), operation of the driving unit 29 shown in FIG. 4 is switched. Note that, for example, a piezoelectric sensor is able to be used for detection of a toner remaining amount, and when there is carrier in addition to the toner, for example, a magnetic permeability sensor is able to be used to detect the toner remaining amount.

Specifically, when the toner remains in the toner cartridge 28, the motor 70 of the driving unit 29 normally rotates, for example, until the toner remaining amount is detected to be zero after the toner cartridge 28 is coupled to the driving unit 29. Thereby, the driving transmission members 71 and 72 shown in FIG. 4 rotate in a counterclockwise manner when viewed in FIG. 4 and the toner conveyance member 61 and the stirring member 62 shown in FIG. 3 rotate to stir the toner while conveying.

When this motor 70 normally rotates, the driving transmission member 73 rotates, for example, in a clockwise manner when viewed in FIG. 4. A direction of the clockwise rotation by the driving transmission member 73 is restricted by the one-way clutch, so that power of the motor 70 is not transmitted to the cam 75 and the cam 75 continues to run idle at that position. Therefore, as shown in FIG. 4, the convex portion 75*b* of the cam 75 remains being separated from the arm 77, and the arm 77 is kept at a position where the toner cartridge 28 is not pushed out (also referred to as a home position).

On the other hand, when the toner remaining amount in the toner cartridge 28 is detected to be zero, the motor 70 of the driving unit 29 reversely rotates, for example, until another toner cartridge is mounted in the driving unit 29 after the toner remaining amount is detected to be zero. Thereby, for example, the driving transmission members 71 and 72 shown in FIG. 4 rotate in the clockwise manner when viewed in FIG. 4, the driving transmission member 73 rotates in the counterclockwise manner when viewed in FIG. 4, and the cam 75 also rotates in the counterclockwise manner.

In addition, when the cam 75 rotates, for example, by about 90° in the counterclockwise manner from the position of FIG. 4, the convex portion 75*b* of the cam 75 starts to push the arm 77. Subsequently, when the cam 75 rotates, for example, by 180° in the counterclockwise manner from the position of FIG. 4, the convex portion 75*b* reaches a position of pushing out the arm 77 to the maximum, so that the arm 77 is at the eject position.

Specifically, as shown in FIG. 7, when the arm 77 is pushed by the convex portion 75*b* of the cam 75, the arm portion 77*b* of the arm 77 rotates in the clockwise manner in a plan view of FIG. 7 against biasing force of the spring 77*c*, thus making it possible to push out the toner cartridge 28.

In this manner, when the toner cartridge 28 is detached, only this toner cartridge 28 is pushed out, for example, by about 15 mm toward a user side. Thereby, as shown in FIG. 8, for example, a gap to an extent where the finger of the user enters therein is formed between the rear side of the front cover 64 and the storage opening 81, so that the user is able to hold the front cover 64.

Moreover, according to this first embodiment, since the pushing-out device pushes out the toner cartridge 28 with the driving force from the driving unit 29 which drives the toner conveyance member and the stirring member, it is possible to push out the toner cartridge with the less number of components than a case where a different driving unit from the driving unit is used for operation of the arm 77.

Note that, when the toner remaining amount in the toner cartridge 28 is detected to be zero, an attention-drawing message that please replace the toner cartridge may be displayed, for example, on an operation portion 51 which is provided in a vicinity of the paper discharge tray 50 of FIG. 1 and receives operation for the image forming apparatus 1. It is also possible to carry out audio guidance. Pop-up display also may be carried out.

Further, a plurality of types of stepwise attention-drawing messages that the toner cartridge is still able to be used may be displayed on the operation portion 51 until toner end indicating that the usable toner completely runs out is detected by the toner detection device in the intermediate hopper 27 described in FIG. 1. Specifically, when toner near end indicating that the toner in the toner cartridge 28 runs out completely is detected by the toner detection device in the toner cartridge 28, an attention-drawing message that the toner cartridge is replaceable is displayed on the operation portion 51. Then, when toner near near end indicating that usable toner is little left is detected by the toner detection device in the intermediate hopper 27, an attention-drawing message that the toner cartridge needs to be replaced is displayed on the operation portion 51, and thereafter, when toner end indicating that the usable toner runs out completely is detected, an attention-drawing message that please replace the toner cartridge is displayed on the display portion 51. Audio guidance or pop-up display may be carried out.

Note that, in the embodiment described above, the cam 75 is rotatable in the counterclockwise manner even after pushing the arm 77 with the convex portion 75*b* thereof. Therefore, when the cam 75 further rotates from the position of FIG. 7 and pushing-out of the arm 77 by the convex portion 75*b* is finished, the arm 77 shown in FIG. 7 returns to the home position shown in FIG. 4 with biasing force of the spring 77*c*, and then, is to be at the eject position and the home position repeatedly with rotation of the cam 75.

Thus, for example, when it is determined that shift from the eject position to the home position was able to be detected by the arm position detection sensor 78, driving of the motor 70 may be stopped, in order to keep the home position which was switched from the eject portion. Alternatively, a time required to move to the home position again through the eject position from the home position may be measured in advance, and when it is determined that the moving time has elapsed after the toner remaining amount is detected to be zero and the motor 70 is driven reversely, the reverse driving of the motor 70 may be stopped. Note that, a driving time of the motor 70 is also able to be managed with a pulse number.

Second Embodiment

Figure 9:
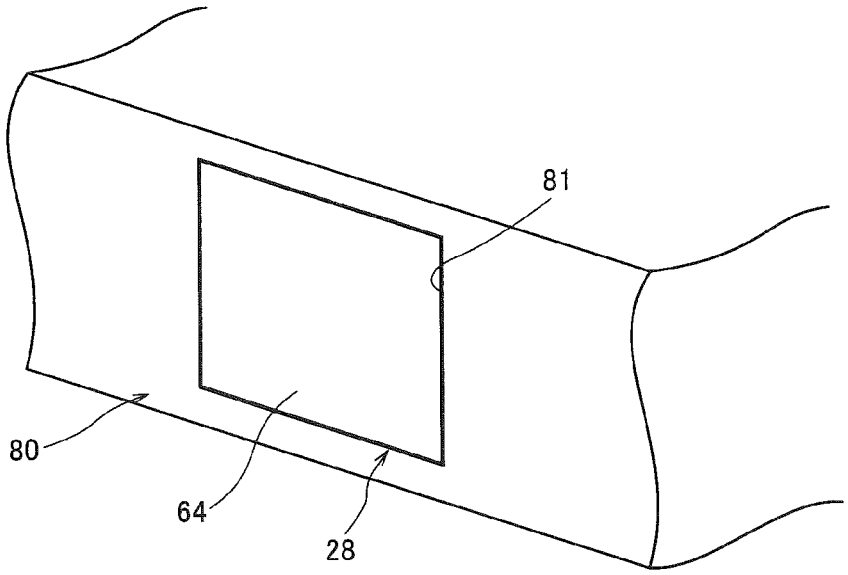
FIG. 9 is a view showing a replaceable state of the toner cartridge according to a second embodiment.

FIG. 9 is a view showing a replaceable state of the toner cartridge according to a second embodiment. In the aforementioned first embodiment, as described in FIG. 6, the rear side of the front cover 64 makes contact with the peripheral part of the storage opening 81 and the front cover 64 is positioned in the front side of the storage opening 81.

Meanwhile, this storage opening 81 may be formed with such an area that allows covering all peripheral edges of the front cover 64 and the cartridge storage portion 80 may be formed with such a depth that allows making the front cover 64 (surface seen from the user) and the peripheral part of the storage opening 81 flat as shown in FIG. 9. In this case, the user is not able to hold the front cover.

Third Embodiment

Figure 10:
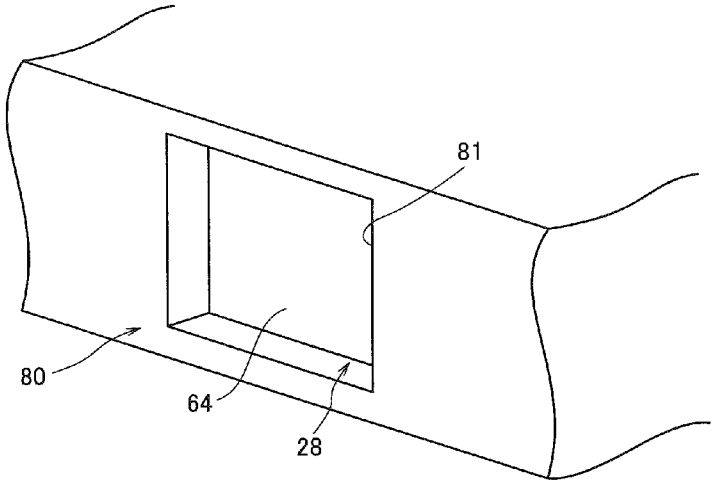
FIG. 10 is a view showing a replaceable state of the toner cartridge according to a third embodiment.

FIG. 10 is a view showing a replaceable state of the toner cartridge according to a third embodiment, and the cartridge storage portion 80 may be formed with such a depth that the front cover 64 enters further deeply compared to the first and second embodiments. In this case as well, in the same manner as the first and second embodiments, a gap formed between the front cover 64 and the storage opening 81 has a size less than a predetermined gap through which the front cover 64 is able to be held, so that the user is not able to hold the front cover.

Note that, according to these second and third embodiments, also when the front cover is formed with thickness to an extent of being able to be held by the user, the front cover is not able to be held.

Fourth Embodiment

Figure 11:
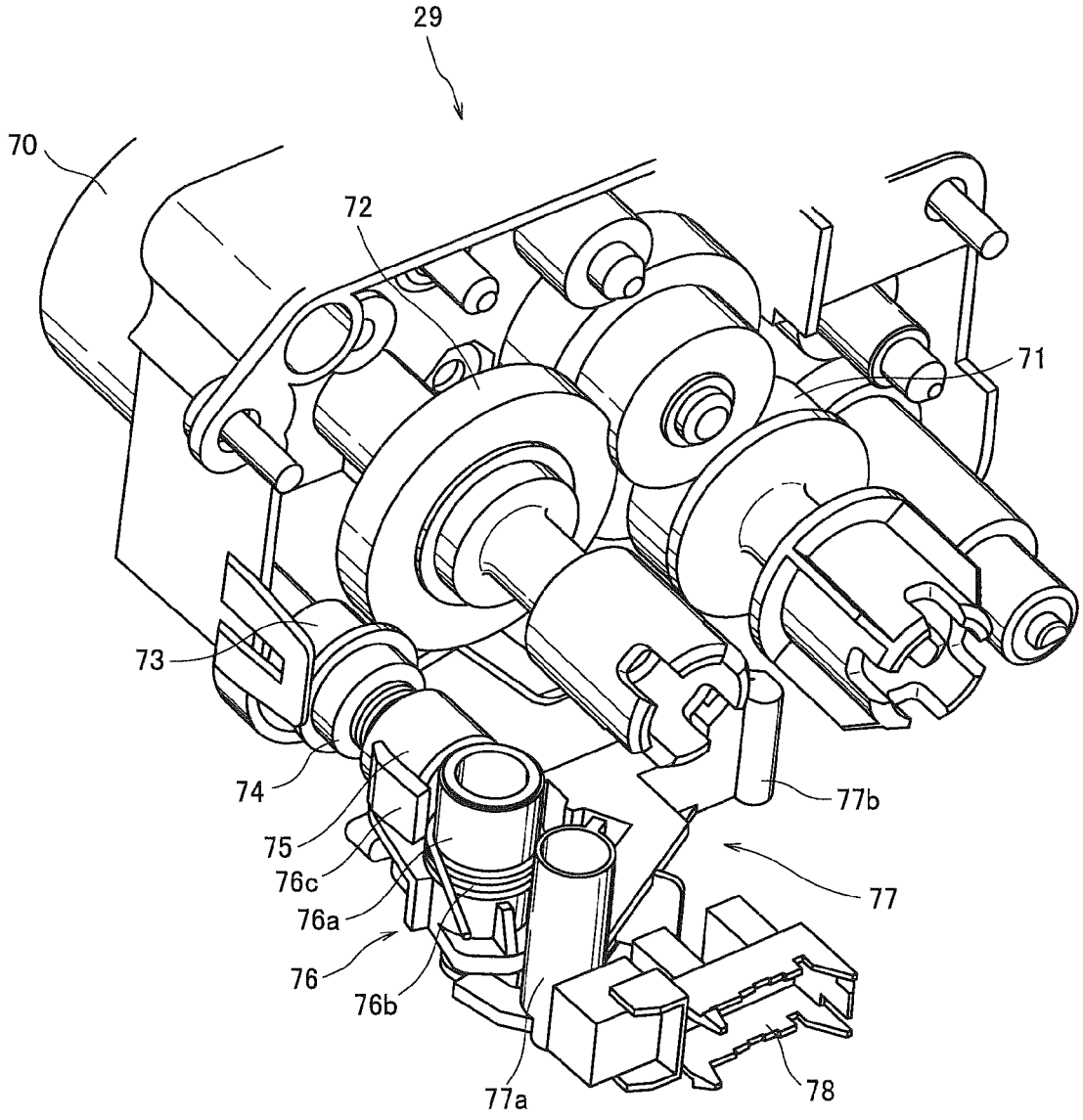
FIG. 11 is a view illustrating operation of the driving unit according to a fourth embodiment.

FIG. 11 is a view illustrating operation of the driving unit according to another embodiment. Though description has been given by taking the solid cam as an example in the aforementioned first embodiment, a plane cam is also able to be used. Specifically, to describe a difference from FIG. 4 mainly, a pushing-out device shown in FIG. 11 is composed of a one-way clutch 74, the eject cam 75, an eject lever 76, the eject arm 77 and the arm position detection sensor 78. Note that, the cam 75 corresponds to the cam member of the present invention and the arm 77 corresponds to the arm member of the present invention, respectively.

Moreover, a shaft of the cam 75 is connected to the one-way clutch 74, and the cam 75 runs idle in a predetermined rotation direction. The cam 75 shown in FIG. 11 is, for example, a plane cam, and a convex portion thereof extends in the direction orthogonal to an axis line of the cam 75.

The lever 76 is arranged between the cam 75 and the arm 77, and has a shaft portion 76*a* which extends in the direction orthogonal to the axis line of the cam 75 and an arm portion 76*c* which extends toward the cam 75 from the shaft portion 76*a*. On the other hand, the arm 77 has the shaft portion 77*a* which extends in the direction orthogonal to the axis line of the cam 75 and the arm portion 77*b* which is integrally formed with the shaft portion 77*a*.

Note that, the lever 76 has, for example, a pin (or long hole), which is not shown in the figure, between the shaft portions 76*a* and 77*a*, and the arm 77 has a long hole (or pin) which is engaged with this pin (or long hole). Therefore, when, with rotation of the lever 76, the pin (or long hole) on the lever 76 side causes the shaft portion 77*a* to rotate with the long hole (or pin) on the arm 77 side, the arm portion 77*b* rotates about the shaft portion 77*a*.

Moreover, a spring 76*b* (for example, torsion coil spring) is installed in the shaft portion 76*a* of the lever 76 to bias the arm portion 77*b* of the arm 77 in a direction away from the toner cartridge 28. Note that, the spring 76*b* corresponds to the spring member of the present invention.

Figure 12A:
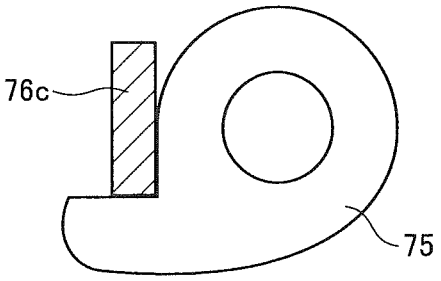
FIG. 12A and FIG. 12B are views illustrating operation of the driving unit of FIG. 11.
Figure 12B:
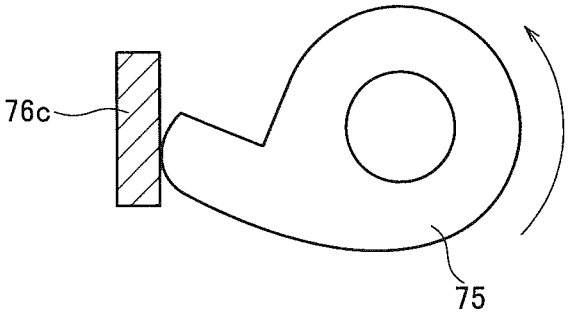
Figure 13:
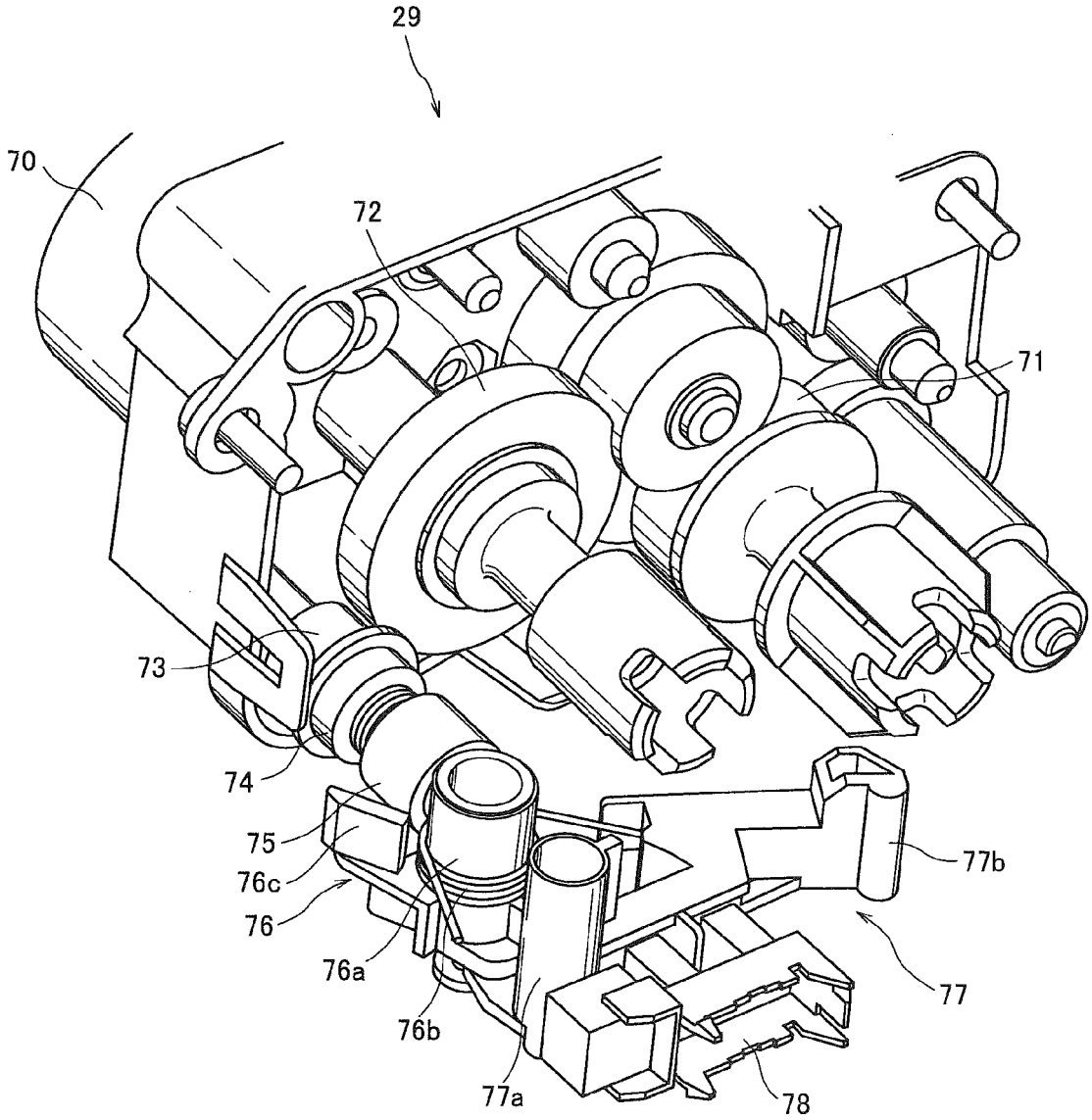
FIG. 13 is a view illustrating operation of the driving unit of FIG. 11.

FIG. 12A, FIG. 12B and FIG. 13 are views illustrating operation of the driving unit of FIG. 11, and, for example, when the toner remains in the toner cartridge 28, the motor 70 of the driving unit 29 shown in FIG. 11 normally rotates and the toner conveyance member 61 and the stirring member 62 shown in FIG. 3 rotate to stir the toner while conveying. In this case, a direction of clockwise rotation by the driving transmission member 73 is restricted by the one-way clutch 74, so that power of the motor 70 is not transmitted to the cam 75 and the cam 75 continues to run idle at that position. Therefore, as shown in FIG. 11 and FIG. 12A, the arm portion 76*c* of the lever 76 remains being proximate to an axial center of the cam 75 and the arm 77 is kept at the home position.

On the other hand, when the toner remaining amount in the toner cartridge 28 is detected to be zero, the motor 70 of the driving unit 29 reversely rotates, and, for example, the driving transmission members 71 and 72 shown in FIG. 11 rotate in the clockwise manner when viewed in FIG. 11, the driving transmission member 73 rotates in the counterclockwise manner when viewed in FIG. 11, and the cam 75 also rotates in the counterclockwise manner.

Then, when the cam 75 rotates, for example, by 332° in the counterclockwise manner from the position of FIG. 12A, the arm portion 76*c* of the lever 76 reaches a position farthest from the axial center of the cam 75, so that the arm 77 is at the eject position.

Specifically, as shown in FIG. 12B, when the arm portion 76*c* is pushed by the convex portion of the cam 75, the lever 76 rotates in the counterclockwise manner in a plan view of FIG. 13 against biasing force of the spring 76*b*, so that the arm portion 77*b* of the arm 77 is able to rotate in the clockwise manner in a plan view to push the toner cartridge 28.

Thereby, only the toner cartridge 28 is pushed out, for example, by about 15 mm toward the user side, and as described in FIG. 8, the user is able to hold the front cover 64.

In the meantime, description has been given in each of the aforementioned embodiments by taking an example in which the toner cartridge is pushed out based on the toner remaining amount. However, the present invention may be configured so that when a trouble is caused in the toner cartridge, or when detachment of the toner cartridge is set, for example, at the operation portion 51 shown in FIG. 1, the toner cartridge is pushed out.

Specifically, for example, when abnormality of toner conveyance operation or stirring operation by the toner conveyance member 61 or the stirring member 62 described in FIG. 3 is detected, a trouble content thereof and the like may be displayed on the operation portion 51 as well as the toner cartridge may be pushed out toward the user side. Audio guidance or pop-up display may be carried out. In this case, it is possible to make replacement of the toner cartridge difficult until a trouble is caused in the toner cartridge.

Further, when detachment of the toner cartridge is set, for example, like when, for example, a "detach the toner cartridge" button is pressed at the operation portion 51, the toner cartridge may be pushed out toward the user side. In this case, it is possible to make replacement of the toner cartridge difficult until detachment of the toner cartridge is set at the operation portion.

Note that, the eject cam described above may be driven with a motor dedicated for the cam, and, though the motor and the cam are used for moving the eject arm, a solenoid may be used. Moreover, also a locking member for positioning the toner cartridge may be provided in the image forming apparatus main body.

Further, a dent may be provided on the rear side of the front cover described above. Specifically, this dent has a size to an extent where the finger of the user does not enter therein when the toner cartridge is coupled to the driving unit, but when the toner cartridge is pushed out, it is formed with a size to an extent where the user is able to hold the front cover easily, thus making it possible to make the user recognize a holding position of the front cover.

As described above, according to the present invention, when the toner cartridge is attached, the cartridge storage portion prevents the end part of the toner cartridge from being held. Thus, it is possible to prevent the toner cartridge from being detached from the image forming apparatus main body without using a mechanism for locking pulling-out of the cartridge so that toner is able to be used up.

Figure 14:
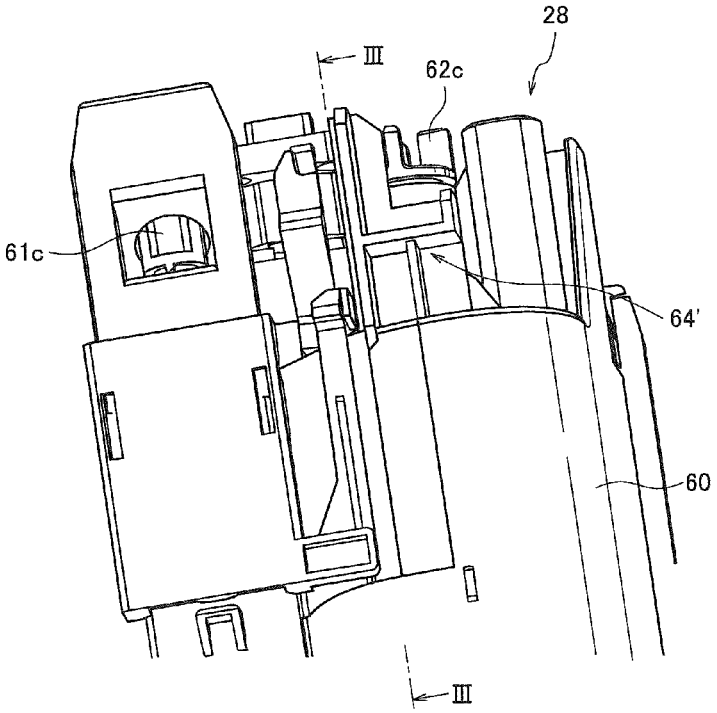
FIG. 14 is a partial enlargement view of the toner cartridge.

Subsequently, FIG. 14 is a partial enlargement view of the toner cartridge. FIG. 14 shows the toner cartridge 28 of FIG. 3 when viewed from bottom, and a to-be-locked portion 64' is provided on a lower surface of the container main body 60. Specifically, the to-be-locked portion 64' is formed by, for example, a wall surface which extends across a longitudinal direction of the container main body 60 or the like, and is installed to be visible from outside the container main body 60 in a vicinity of the driving transmission member 61*c* or the driving transmission member 62*c* described above.

Fifth Embodiment

Figure 15:
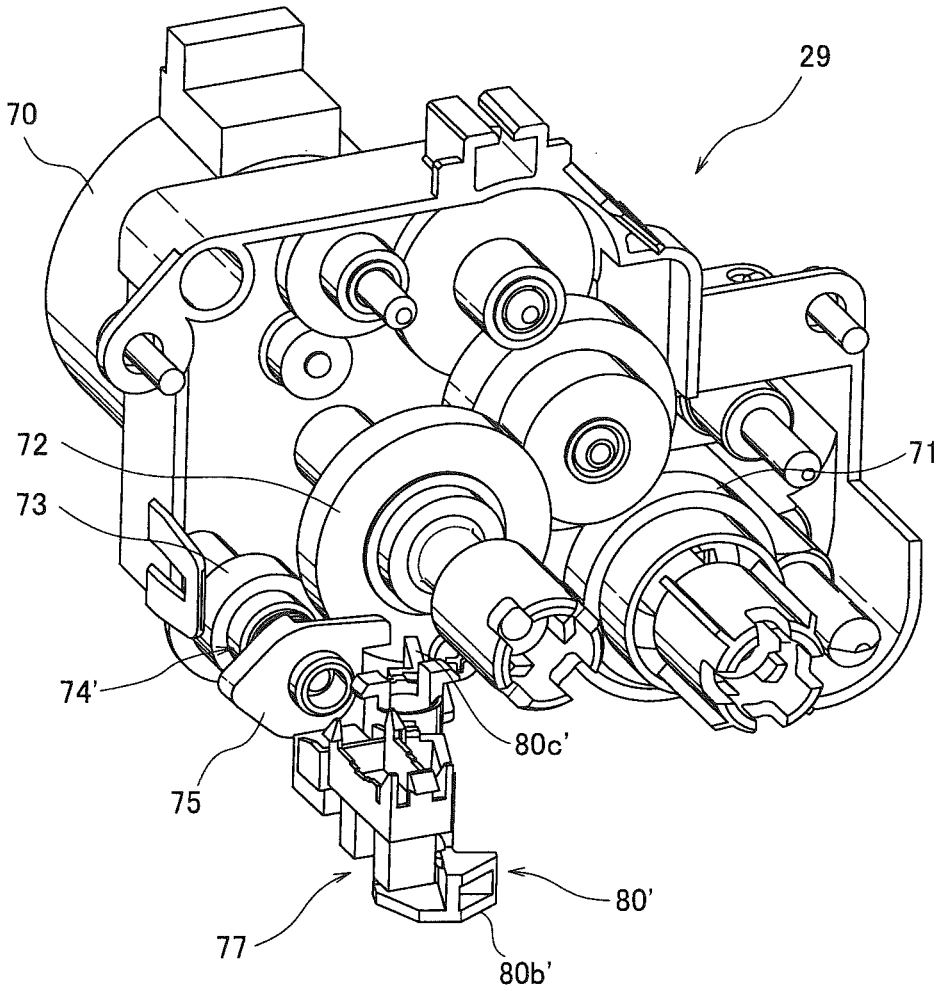
FIG. 15 is a perspective view of the driving unit according to a fifth embodiment.

FIG. 15 is a perspective view of the driving unit according to a fifth embodiment, which is viewed from obliquely left upward in the same manner as FIG. 2. The driving unit 29 has driving transmission members 71, 72 and 73 for transmitting driving force of the aforementioned motor 70. The driving transmission member 71 is formed so as to be able to be coupled to the driving transmission member 61*c* shown in FIG. 3 and FIG. 14, and transmits the driving force of the motor 70 to the toner conveyance member 61. The driving transmission member 72 is formed so as to be able to be coupled to the driving transmission member 62*c*, and transmits the driving force of the motor 70 to the stirring member 62.

The driving transmission member 73 is coupled to the cam 75, and the cam 75 is configured so as to be rotatable, for example, with driving force of the motor 70. Note that, the shaft of the cam 75 is connected to a torque limiter 74', and rotation torque from the motor 70 is blocked in a predetermined rotation direction when a set torque value is exceeded, so that the cam 75 runs idle.

Here, the driving unit 29 has a locking member 80'. Specifically, the locking member 80' is composed of an shaft portion 80*a'* (shown in FIG. 16A, FIG. 16B, FIG. 17A and FIG. 17B described below), a hook portion 80*b'* and an abutting portion 80*c'*, the abutting portion 80*c'* abuts against or is separated from the cam 75, and the hook portion 80*b'* is formed so as to be able to be engaged with the to-be-locked portion 64' of the toner cartridge 28, which has been described in FIG. 14.

The shaft portion 80*a'* shown in FIG. 16A, FIG. 16B, FIG. 17A and FIG. 17B described below is arranged between the hook portion 80*b'* and the abutting portion 80*c'*, and extends in the direction orthogonal to the shaft of the cam 75. Moreover, a spring 76' (for example, torsion coil spring) is installed in the shaft portion 80*a'*, and biases the locking member 80' in a direction to be engaged with the to-be-locked portion 64' of the toner cartridge 28. Note that, for example, a retreat position detection sensor 77' having a light emitting element and a light receiving element is provided in a vicinity of the hook portion 80*b*', and when light from the light emitting element is blocked by the hook portion 80*b*', retreat of the locking member 80' is able to be detected.

In this manner, since the driving unit 29 has the locking member 80' which is engaged with the to-be-locked portion 64' of the toner cartridge 28, even if lock of a cover of the image forming apparatus main body is released or the cover of the image forming apparatus main body is opened, it is possible to prevent the toner cartridge 28 from being detached from the driving unit 29.

Further, since a state of the locking member 80' is attained by the cam 75 and the spring 76', it is possible to seek reduction of manufacturing cost of the image forming apparatus.

Figure 16A:
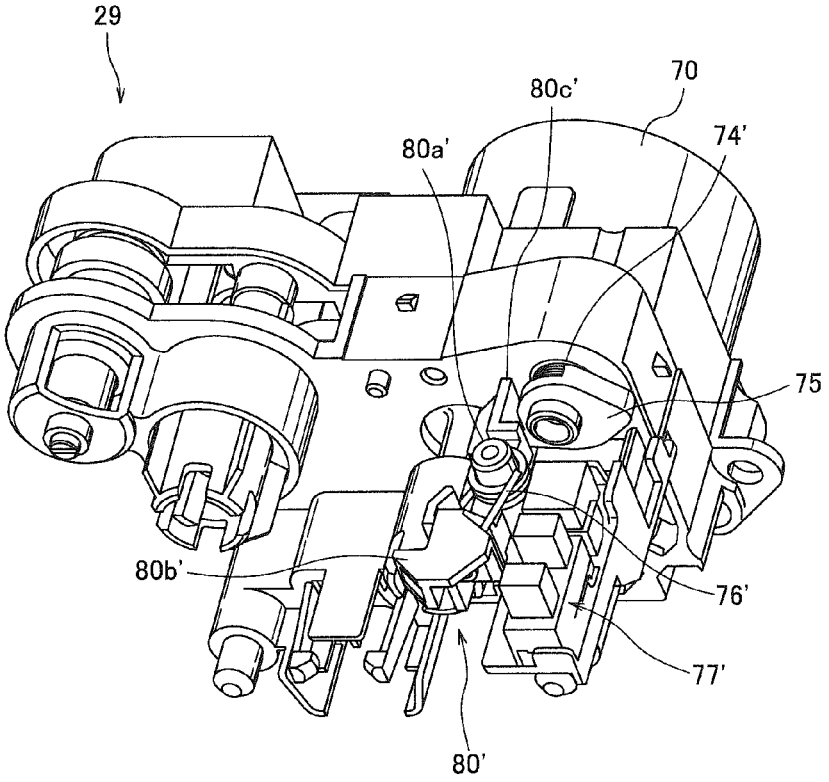
FIG. 16A and FIG. 16B are views showing a lock state of the toner cartridge.
Figure 16B:
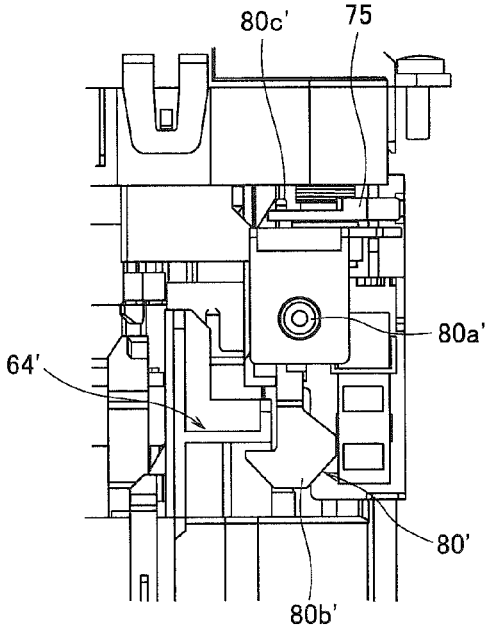
Figure 17A:
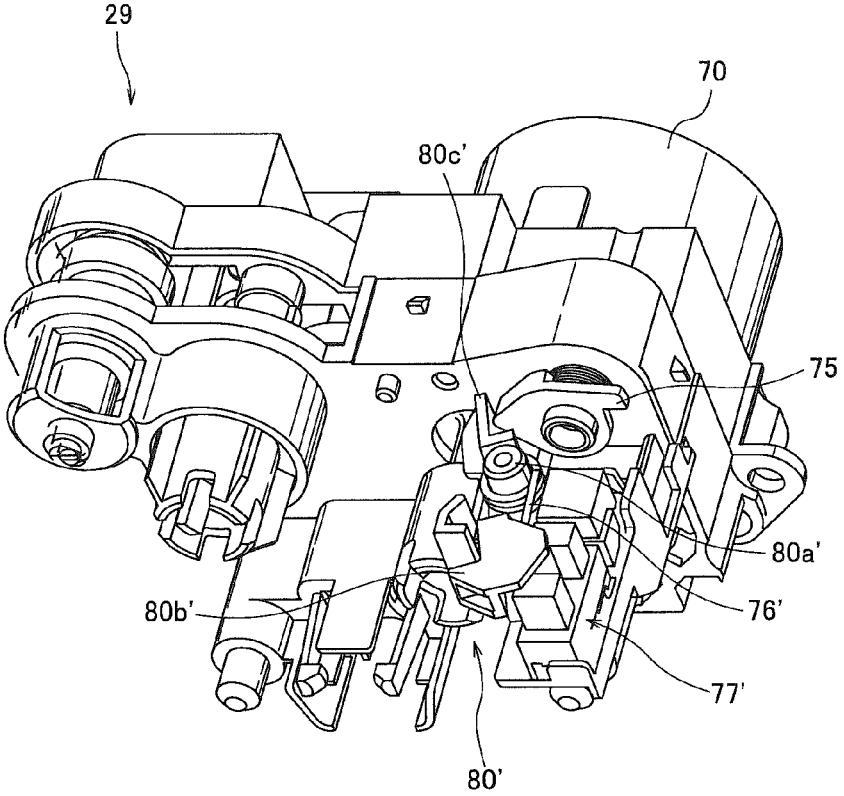
FIG. 17A and FIG. 17B are views showing a lock released state of the toner cartridge.
Figure 17B:
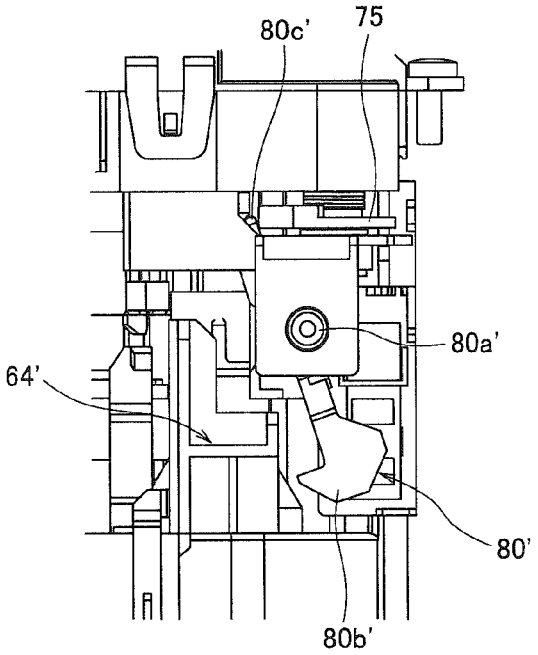

FIG. 16A and FIG. 16B are views showing a lock state of the toner cartridge, and FIG. 17A and FIG. 17B are views showing a lock released state of the toner cartridge, all of which show the toner cartridge 28 of FIG. 3 when viewed from bottom in the same manner as FIG. 14.

The locking member 80' of the present embodiment is engaged with the toner cartridge 28 or has engagement with the toner cartridge 28 released based on a detection signal of a toner detection sensor (not shown in the figures), for example.

Specifically, when the toner remaining amount in the toner cartridge 28 is not detected to be zero, the motor 70 of the driving unit 29 normally rotates, for example, until the toner remaining amount is detected to be zero after the toner cartridge 28 is mounted in the driving unit 29. Thereby, the driving transmission members 71, 72 and 73 shown in FIG. 15 rotate in the counterclockwise manner when viewed in FIG. 15 and the toner conveyance member 61 and the stirring member 62 shown in FIG. 3 rotate to stir toner while conveying as well as the cam 75 also rotates in the counterclockwise manner in the case of the set torque value or less.

A direction of this counterclockwise rotation is restricted by the torque limiter 74', and when the convex portion of the cam 75 reaches a position farthest from the abutting portion 80*c*' of the locking member 80' as shown in FIG. 16A and the set torque value is exceeded, the cam 75 continues to run idle at that position. Therefore, as shown in FIG. 16B, the hook portion 80*b*' of the locking member 80' moves toward the to-be-locked portion 64' of the toner cartridge 28 with biasing force of the spring 76' and is engaged with the to-be-locked portion 64' (also referred to as a lock state of the locking member).

On the other hand, when the toner remaining amount in the toner cartridge 28 is detected to be zero, the motor 70 of the driving unit 29 reversely rotates, for example, until another toner cartridge is mounted in the driving unit 29 after the toner remaining amount is detected to be zero. Thereby, the driving transmission members 71, 72 and 73 shown in FIG. 15 rotate in the clockwise manner when viewed in FIG. 15, and the cam 75 also rotates in the clockwise manner.

This cam 75 which rotates in the clockwise manner retreats the locking member 80'. Specifically, as shown in FIG. 17A, the abutting portion 80*c*' of the locking member 80' is pushed by the convex portion of the cam 75. Therefore, as shown in FIG. 17B, the hook portion 80*b*' of the locking member 80' moves in a direction away from the to-be-locked portion 64' of the toner cartridge 28 against biasing force of the spring 76' so that engagement with the to-be-locked portion 64' is released (also referred to as a lock released state of the locking member).

In this manner, since the state of the locking member 80' is set based on the toner remaining amount in the toner cartridge 28, when toner remains in the toner cartridge 28, it is possible to make replacement of the toner cartridge 28 difficult.

Note that, when the toner remaining amount in the toner cartridge 28 is detected to be zero, an attention-drawing message that please replace the toner cartridge may be displayed, for example, on the operation portion 51 which is provided in the vicinity of the paper discharge tray 50 of FIG. 1 and receives operation for the image forming apparatus 1. It is also possible to carry out audio guidance.

Moreover, when the toner cartridge is removed in the lock state of the locking member, damage of the locking member is caused. Thus, in order to prevent the damage of the locking member, it may be set so that removal of the toner cartridge is not made impossible, but the toner cartridge is able to be removed, in which a load at that time is increased. Further, an attention-drawing message that the toner cartridge is not able to be detached in the lock state of the locking member or that the toner cartridge is still able to be used until the toner remaining amount is detected to be zero may be displayed on the operation portion 51 or audio guidance may be carried out.

Note that, in the embodiment described above, the direction of counterclockwise rotation is restricted by the torque limiter 74', but the direction of clockwise rotation is not restricted by the torque limiter 74'. Therefore, when the cam 75 still continues to rotate in the clockwise manner, the locking member 80', after being in the aforementioned lock released state, is to repeat postures of the lock state, the lock released state and the lock state. Thus, after being in the lock released state, in order to keep this state, for example, when it is determined that it was possible to detect retreat of the locking member 80' by the retreat position detection sensor 77', driving of the motor 70 may be stopped. Alternatively, a time required for the locking member to move from the lock state to the lock released state may be measured in advance, and when it is determined that the moving time has elapsed after the toner remaining amount is detected to be zero and the motor 70 is driven reversely, the reverse driving of the motor 70 may be stopped. Note that, a driving time of the motor 70 is also able to be managed with a pulse number. Further, the direction of counterclockwise rotation is restricted when the set torque value is exceeded. Thus, a time required for the locking member to move from the lock released state to the lock state may be measured in advance, and when it is determined that the moving time has elapsed after the motor 70 is driven normally, driving force of the motor 70 in a normal rotation direction may be controlled so as to exceed the set torque value.

Sixth Embodiment

Figure 18A:
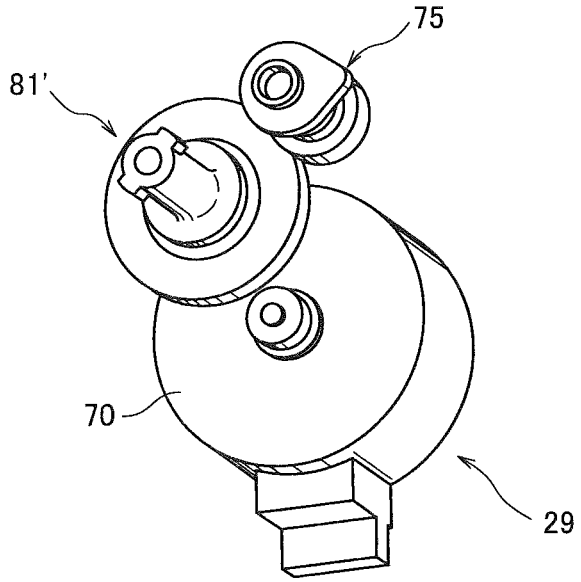
FIG. 18A and FIG. 18B are illustrative views of the driving unit according to a sixth embodiment.
Figure 18B:
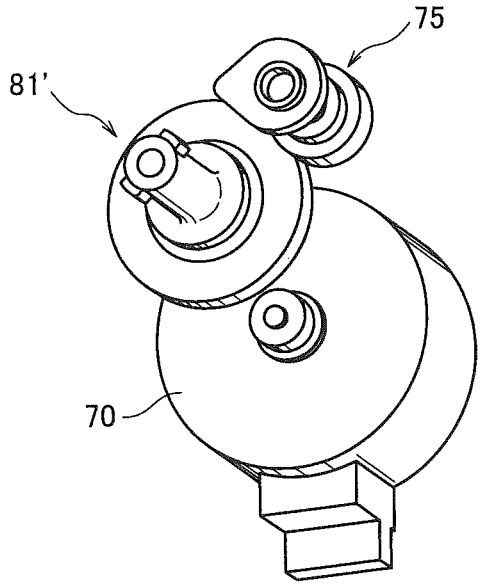

FIG. 18A and FIG. 18B are illustrative views of the driving unit according to a sixth embodiment. Though description has been given by taking an example in which the cam in the aforementioned fifth embodiment is driven by the motor 70 of the driving unit 29, a motor dedicated for the cam may be provided.

Specifically, as shown in FIG. 18A, the driving unit 29 includes a motor for a cam 81' separately from the motor 70, and the cam 75 rotates with driving force of the motor for a cam 81', and, for example, when the toner remaining amount in the toner cartridge 28 is not detected to be zero, takes a posture making the locking member into a lock state (FIG. 18A), and when the toner remaining amount in the toner cartridge 28 is detected to be zero, takes a posture making the locking member into a lock released state (FIG. 18B).

In this manner, by using the motor dedicated for the cam, the driving unit 29 for conveying toner while stirring is able to use, for example, a versatile motor capable of only normal rotation. Moreover, since it is driven separately from the motor 70 of the driving unit 29, the torque limiter is also able to be omitted.

Seventh Embodiment

Figure 19A:
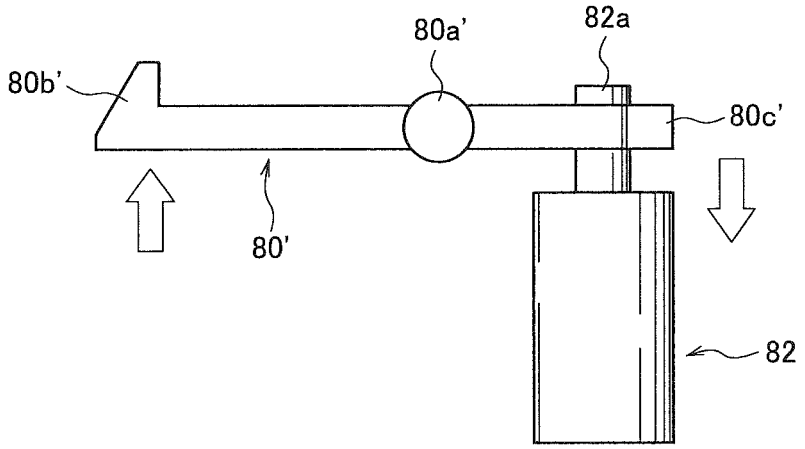
FIG. 19A and FIG. 19B are illustrative views of the driving unit according to a seventh embodiment.
Figure 19B:
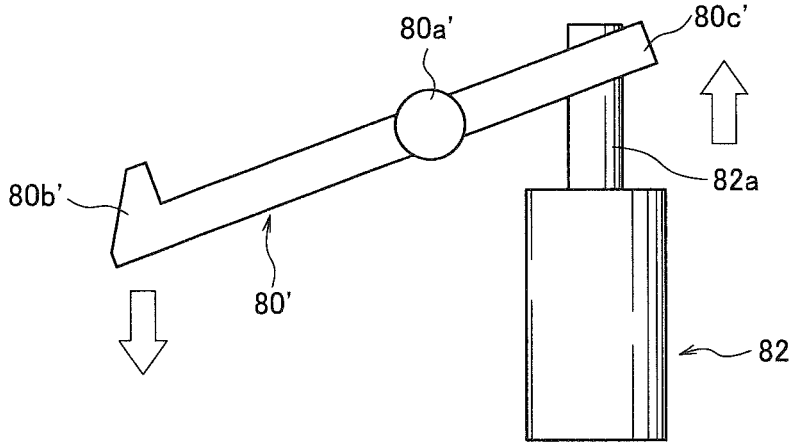

FIG. 19A and FIG. 19B are illustrative views of the driving unit according to a seventh embodiment. Though the cam is used for moving the locking member in the aforementioned fifth and sixth embodiments, a solenoid may be used.

Specifically, a solenoid 82 having a plunger 82*a* is arranged in a vicinity of the locking member 80' as shown in FIG. 19A and FIG. 19B. The plunger 82*a* is coupled to the abutting portion 80*c*', and, for example, when the toner remaining amount in the toner cartridge 28 is not detected to be zero, the plunger 82*a* is sucked into the solenoid 82 by turning-on operation of the solenoid 82 (FIG. 19A), so that the locking member is made into the lock state. On the other hand, when the toner remaining amount in the toner cartridge 28 is detected to be zero, the plunger 82*a* is protruded outward with turning-off operation of the solenoid 82 (FIG. 19B), so that the locking member is made into the lock released state.

In this manner, since the lock state and the lock released state of the locking member is performed by the solenoid 82, the cam and the like are able to be omitted, and it is possible to save a space in the image forming apparatus main body.

Meanwhile, description has been given in each of the aforementioned embodiments by taking an example in which the locking member is turned into the lock state or the lock released state based on the toner remaining amount. However, in the present invention, the locking member may be turned into the lock state or the lock released state when a trouble is caused in the toner cartridge, or when detachment of the toner cartridge is set, for example, at the operation portion 51 shown in FIG. 1.

Specifically, for example, when abnormality of toner conveyance operation or stirring operation by the toner conveyance member 61 or the stirring member 62 described in FIG. 3 is detected, a trouble content thereof and the like may be displayed on the operation portion 51 as well as engagement of the locking member with the to-be-locked portion of the toner cartridge may be released. Audio guidance also may be carried out. In this case, it is possible to make replacement of the toner cartridge difficult until a trouble is caused in the toner cartridge.

Further, when detachment of the toner cartridge is set, for example, like when, for example, a "detach the toner cartridge" button is pressed at the operation portion 51, engagement of the locking member with the to-be-locked portion of the toner cartridge may be released. In this case, it is possible to make replacement of the toner cartridge difficult until detachment of the toner cartridge is set at the operation portion.

As above, according to the present invention, since the driving unit has the locking member which is engaged with the toner cartridge, even if the cover of the image forming apparatus main body is opened, it is possible to prevent the toner cartridge from being detached from the driving unit.

The invention claimed is:

1. An image forming apparatus, comprising:

a cartridge storage portion that is installed in an image forming apparatus main body and extends along a longitudinal axis; and a toner cartridge that is configured so as to be able to be inserted into and removed from the cartridge storage portion, the toner cartridge having a first end part which does not include a handle and having a second end part longitudinally opposite the first end part, wherein the cartridge storage portion has a storage opening that receives the toner cartridge, the toner cartridge is inserted longitudinally into the cartridge storage portion, leading with the second end, and when the toner cartridge is fully-inserted into the cartridge storage portion such that the toner cartridge is able to convey toner, the first end part remains exposed from the cartridge storage portion and the image forming apparatus main body, and a gap, through which the first end part of the toner cartridge is not able to be held, is between the first end part of the toner cartridge and the storage opening.

2. The image forming apparatus according to claim 1, wherein the image forming apparatus further includes a driving unit that is installed in the image forming apparatus main body and configured so as to be detachable from the toner cartridge, and the driving unit has a toner cartridge pushing-out device that allows the end part of the toner cartridge to be held by pushing out the toner cartridge when the toner cartridge is detached from the driving unit.

3. The image forming apparatus according to claim 2, wherein the toner cartridge pushing-out device has an arm member capable of pushing out the toner cartridge, a cam member that rotates based on driving force from the driving unit and pushes the arm member in a direction to be proximate to the toner cartridge, and a spring member that biases the arm member in a direction away from the toner cartridge.

4. The image forming apparatus according to claim 2, wherein the toner cartridge pushing-out device pushes out the toner cartridge when the toner remaining amount in the toner cartridge is detected to be zero.

5. The image forming apparatus according to claim 2, wherein the toner cartridge further includes a toner conveyance member or a stirring member that is driven by the driving unit, and the toner cartridge pushing-out device pushes out the toner cartridge when abnormality of toner conveyance operation by the toner conveyance member or stirring operation by the stirring member is detected.

6. The image forming apparatus according to claim 2, wherein the image forming apparatus further includes an operation portion that receives operation for the image forming apparatus, and the toner cartridge pushing-out device pushes out the toner cartridge when detachment of the toner cartridge is set at the operation portion.

* * * * *